US010602889B2

(12) United States Patent
Paul

(10) Patent No.: US 10,602,889 B2
(45) Date of Patent: Mar. 31, 2020

(54) DISPENSER WITH NOISE DAMPENER

(71) Applicant: Alwin Manufacturing Co., Inc., Green Bay, WI (US)

(72) Inventor: Ryan M. Paul, Green Bay, WI (US)

(73) Assignee: Alwin Manufacturing Co., Inc., Green Bay, WI (US)

( * ) Notice: Subject to any disclaimer, the term of this patent is extended or adjusted under 35 U.S.C. 154(b) by 378 days.

(21) Appl. No.: 15/407,923

(22) Filed: Jan. 17, 2017

(65) Prior Publication Data

US 2018/0199767 A1 Jul. 19, 2018

(51) Int. Cl.
*A47K 10/38* (2006.01)

(52) U.S. Cl.
CPC ..... *A47K 10/38* (2013.01)

(58) Field of Classification Search
CPC .... A47K 10/36; A47K 10/38; A47K 10/3612; A47K 2010/3233; H02K 5/24; H02K 5/26; H02K 15/14
USPC ..... 310/51, 91
See application file for complete search history.

(56) References Cited

U.S. PATENT DOCUMENTS

| | | | | |
|---|---|---|---|---|
| 3,025,066 | A | 3/1962 | Siebert | |
| 4,452,417 | A | 6/1984 | Krafthefer et al. | |
| 5,004,207 | A | 4/1991 | Ishikawa et al. | |
| 5,449,153 | A | 9/1995 | Catalano et al. | |
| 6,279,866 | B1 * | 8/2001 | Eilemann | F04D 29/668 248/603 |
| 6,378,849 | B1 * | 4/2002 | Erdman | F16F 15/073 188/379 |
| 6,446,901 | B1 | 9/2002 | Haen et al. | |
| 6,460,798 | B1 | 10/2002 | Haen et al. | |
| 6,592,067 | B2 | 7/2003 | Denen et al. | |
| 6,609,450 | B2 | 8/2003 | Granger | |
| 6,695,246 | B1 | 2/2004 | Elliott et al. | |
| 6,894,897 | B1 | 5/2005 | Nagurny et al. | |

(Continued)

FOREIGN PATENT DOCUMENTS

| | | | |
|---|---|---|---|
| JP | 58198142 | A2 | 11/1983 |
| WO | 1997029671 | | 8/1997 |
| WO | 2008042962 | A2 | 4/2008 |

OTHER PUBLICATIONS

Anti Vibration Rubber Mounts. AV Products, Inc. <www.avproductsinc.com>. Date: undated.

(Continued)

*Primary Examiner* — William E Dondero
(74) *Attorney, Agent, or Firm* — Jansson Munger McKinley & Kirby Ltd.

(57) ABSTRACT

A noise dampener for implementation with a sheet material dispenser is disclosed. The dampener attenuates motor and moving part noise audible to a user of the dispenser and quiets dispenser operation. In an embodiment, a noise dampener may be an integral part of the dispenser motor support structure. An embodiment of a noise dampener may include a motor support component, a motor mount component which supports a motor, and a plurality of connectors. The connectors may be integrated with and join the motor support component and the motor mount component to provide support for the motor mount component with respect to the motor support component and to provide spacing between such components collectively reducing noise audible to a user.

22 Claims, 10 Drawing Sheets

(56) References Cited

U.S. PATENT DOCUMENTS

| | | | | |
|---|---|---|---|---|
| 6,903,654 | B2 | 6/2005 | Hansen et al. | |
| 6,977,588 | B2 | 12/2005 | Schotz et al. | |
| 7,040,566 | B1 | 5/2006 | Rodrian et al. | |
| 7,084,592 | B2 | 8/2006 | Rodrian | |
| 7,117,972 | B2 | 10/2006 | Mattson et al. | |
| 7,134,203 | B2 * | 11/2006 | Hutchinson ..... | H05K 7/20172 29/889.3 |
| 7,251,100 | B1 | 7/2007 | Frees et al. | |
| 7,296,765 | B2 | 11/2007 | Rodrian | |
| 7,357,348 | B2 | 4/2008 | Kananen | |
| 7,963,475 | B2 * | 6/2011 | Rodrian ..... | A47K 10/3687 222/63 |
| 8,616,489 | B2 | 12/2013 | Goeking et al. | |
| 8,807,475 | B2 | 8/2014 | Rodrian | |
| 2002/0109035 | A1 | 8/2002 | Denen et al. | |
| 2002/0109036 | A1 | 8/2002 | Denen et al. | |
| 2004/0035976 | A1 | 2/2004 | Byrd et al. | |
| 2004/0135027 | A1 | 7/2004 | Elliott et al. | |
| 2014/0110892 | A1 * | 4/2014 | Wojcieson ..... | F16F 15/08 267/136 |
| 2017/0067485 | A1 * | 3/2017 | Shelton ..... | H02K 5/24 |

OTHER PUBLICATIONS

Medical-Antivibration Mounts for Pharmaceutical Equipment Analyzers Cytomers. <www.vibrationsmounts.com/uses/medical.htm>. Dated: undated.

Alwin Manufacturing Model 234 Specifications. <www.alwin.com/products/roll_towel/234/index.htnl>. Date: 2013.

* cited by examiner

DISPENSER WITH NOISE DAMPENER

FIELD

The field relates to dispensers and, more particularly, to automatic sheet material dispensers with quiet operation.

BACKGROUND

Dispensers for flexible sheet material in the form of a web, such as paper towel, cloth towel, tissue paper and the like are well known in the art. Certain of these dispensers output sheet material by means of a dispensing mechanism powered by a direct current (DC) motor. A dispense cycle occurs when the motor is activated to power the dispensing mechanism to extend a sheet of material out from the dispenser. A single sheet may then be separated from the web, for example, by automatic cutting, by manual tearing, or by separation of a single sheet along a perforation line between sheets.

The dispensing mechanisms implemented with such sheet material dispensers typically include a "nip" formed by abutment of a drive roller and a tension roller. Motor-powered rotation of the drive roller pulls sheet material from a supply roll, through the nip, and out of the dispenser. The DC motors implemented in such sheet material dispensers typically provide high armature RPM speeds needed to operate the dispensing mechanism to extend a sheet to the user. The motor is typically mounted directly to a sidewall or other dispenser support structure. The sidewall or support structure which supports the motor may be part of a dispenser chassis which supports the drive and tension rollers.

While the aforementioned types of dispensers are quite good, there is opportunity for improvement. For example, the DC motor and any gears internal to the motor and/or gears external to the motor used to power the dispensing mechanism can be noisy and can produce vibration. Noise and vibration produced by operation of these, and other, moving parts can be transferred to the dispenser chassis or other support structure to which the motor and gears are attached. The chassis or other support structure can amplify such noise and vibration because such parts are typically made of lightweight plastic and can vibrate, thereby producing resonant noise. The dispenser housing can also provide a type of chamber which amplifies the noise and vibration. All of this dispenser noise is apparent and distinctly audible to a person using the dispenser. The user may unfairly perceive that the audible noise is an indication that the dispenser is of poor quality and workmanship.

Various attempts have been made to lessen or minimize noise and vibration caused by motors and motor-powered moving parts, but these approaches are not optimally effective for use in automatic sheet material dispensers. For example, U.S. Pat. No. 8,616,489 discloses a paper towel dispenser with a rubber isolator between the motor and chassis. An isolator, however, is an extra part and represents an unnecessary cost item in a dispenser product sold into a fiercely competitive market. Motor mounts such as in U.S. Pat. Nos. 4,452,417 and 5,449,153 represent other attempts to dampen motor noise and vibration but accomplish this by implementing additional mounting parts and components which add cost and complexity.

It would be an advance in the art to provide improved sheet material dispensers for paper towel, tissue paper and other materials which would operate quietly with reduced or essentially user-imperceptible noise from motor operation and motor-powered moving parts, which would provide the manufacturer with the opportunity to both provide for quiet dispenser operation with fewer parts and which would generally have improved performance relative to existing dispensers.

SUMMARY

Embodiments of a noise dampener for attenuating and reducing noise and vibration associated with operation of an automatic sheet material dispenser, such as a paper towel dispenser, are described and illustrated herein. Dampener embodiments of the types described herein enable noise reduction while simplifying design, providing opportunities for both an improved dispenser and reduced dispenser cost. Dampener embodiments of the types described herein are effective at attenuating dispenser noise because such dampeners can be configured to provide for isolation of the motor, gears and/or other noise-producing parts from the chassis and dispenser, thereby limiting transfer of noise and vibration into the dispenser. Embodiments of the dampener and a dispenser including the dampener may be configured to meet some or all of the abovementioned needs as well as other requirements which the manufacturer or user may request.

In an embodiment, a dampener may be a component which is integrated with, or forms a part of, a part of the dispenser structure which supports the dispenser motor and which may also support one or more gear in power-transmission relationship with the motor. Such moving parts can produce noise and vibration during dispenser operation and dampeners of the types described herein can reduce noise audible to a user of the dispenser. Examples of representative motor support structure into which the dampener may be incorporated are the chassis which supports the motor and other moving parts (e.g., gears, or drive and tension rollers), a sidewall of the chassis, or other structure associated with the dispenser.

In embodiments, a noise dampener may include a motor support component, a motor mount component, a noise-dampening gap and plural connectors which provide for support of the motor mount component with respect to the motor support component.

In embodiments, the motor support component may be a part of the aforementioned chassis, chassis sidewall, or other motor support structure. In certain embodiments, the motor support structure and motor support component are the same part and are made of the same plastic material. In embodiments, the chassis sidewall and motor support component may define a plane. Such components and the chassis sidewall may lie fully or partially in the plane.

A motor mount component may be adjacent the motor support component and may be of the same plastic material as the motor support component. The motor support component and motor mount component are spaced apart to define a noise-dampening gap between the motor support component and motor mount component to isolate the motor mount component from the chassis, chassis sidewall and other parts of the dispenser to thereby lessen noise and vibration transfer from the motor and any gears into the dispenser. In embodiments, the gap may be substantially around the motor mount component. The motor mount component and gap may lie fully or partially in the plane.

The connectors may be made of the same plastic material as are the motor support component and motor mount component. In embodiments, the motor support structure, motor support component, motor mount component and connectors are elements of a single integrated part and provide a one-piece or single integrated unit. For example, a chassis or a chassis sidewall may be provided with the dampener integrated therein, thereby providing a unitary or single part or component part. The dampener and motor support structure can be made, for example, as a single injection molded part. The gap could be formed in the injection molded part. In other embodiments, the gap could be added to the part, such as by removing material by machining processes or the like. Inclusion of the dampener in the motor support structure provides an opportunity for part reduction and dispenser simplification.

The quantity of connectors implemented in a dampener may be selected based on the dispenser embodiment. Such connectors bridge the gap and join the motor support component and motor mount component to provide support for the motor mount component with respect to the motor support component. In embodiments, the connectors each have a first end integral with the motor support component, a second end integral with the motor mount component and a connector body integral with the first and second ends.

Connectors which may be implemented in connection with dampener embodiments may have various configurations. In an embodiment, the connectors may include a substantially U-shaped portion between the first and second ends. The U-shaped portion of the connector may lie in the plane. In other embodiments, the connectors may further include a non-planar portion, such as a bowed portion, between the first and second ends and the non-planar portion may be at least partially outside the plane.

Other aspects and examples of the dispenser and invention are described in the disclosure which follows.

BRIEF DESCRIPTION OF THE DRAWINGS

Exemplary dispensers and dampener structure to reduce or eliminate dispenser noise audible to a user during dispenser operation may be understood by reference to the following description taken in conjunction with the accompanying drawings, in which like reference numerals identify like elements throughout the different views. The drawings are not necessarily to scale, emphasis instead being placed upon illustrating the principles of the invention. The drawings depict only embodiments of the invention and are not therefore to be considered as limiting the scope of the invention. In the accompanying drawings.

DETAILED DESCRIPTION

Referring now to FIGS. 1-10 there is shown an embodiment of an exemplary dispenser 10 and two embodiments of noise-dampening structure comprising a noise dampener 11, 11*a* which may be implemented for use with dispenser 10. In the embodiments, noise dampener 11, 11*a* is effective at attenuating noise from operation of a motor, gears, and other moving parts of dispenser 10. Noise audible to a typical human during use and operation of dispenser 10 may be lessened or eliminated by means of noise dampeners 11, 11*a* in accordance with the invention, providing a more pleasant experience for the user while correctly conveying the impression that the dispenser 10 is of the highest quality. For convenience, noise dampener embodiments 11, 11*a* are also referred to herein as noise-dampening structure, or simply by the term dampener.

Figure 1:
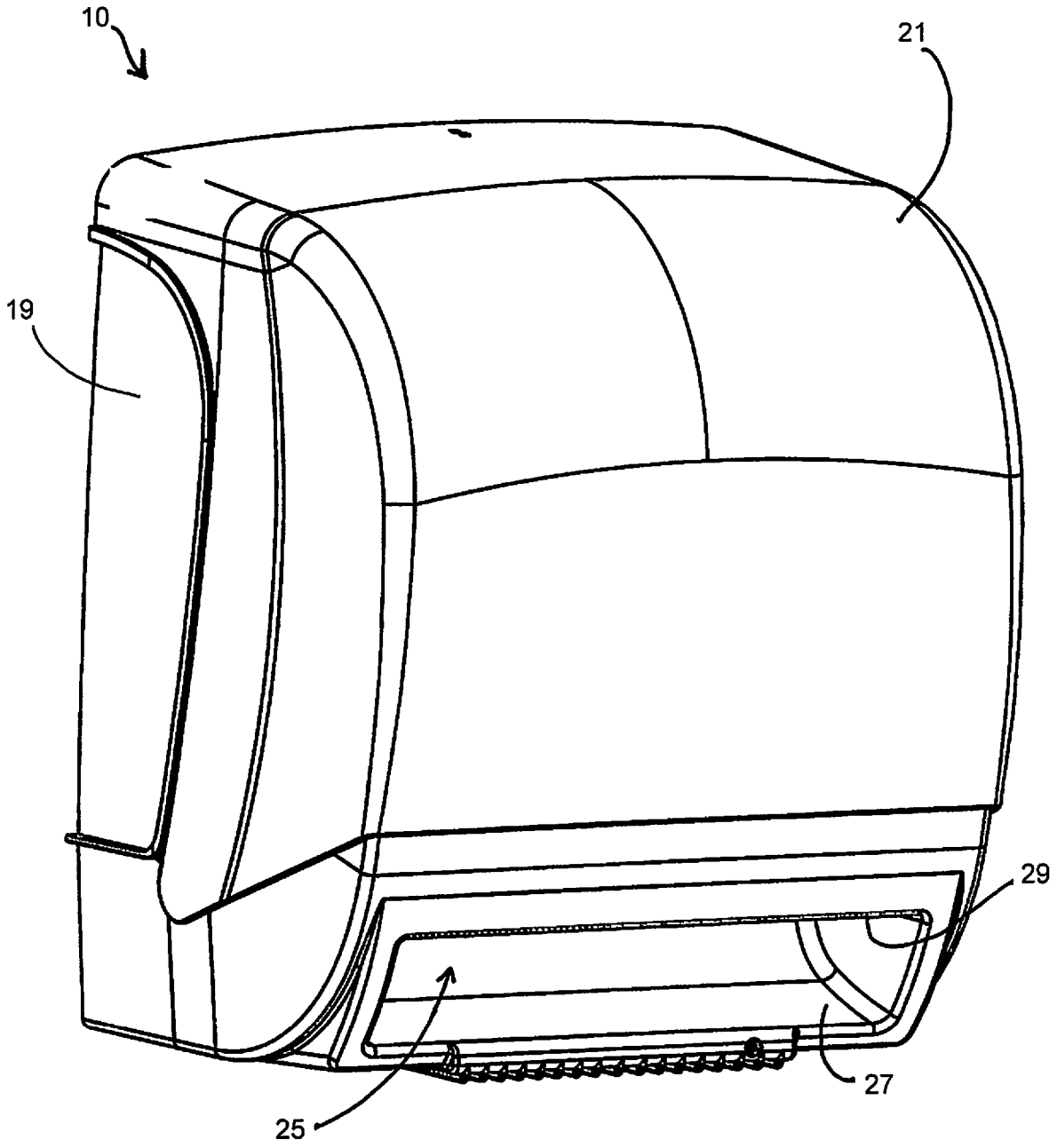
FIG. 1 is a perspective view of an exemplary dispenser including a noise dampener in accordance with the invention.
Figure 2:
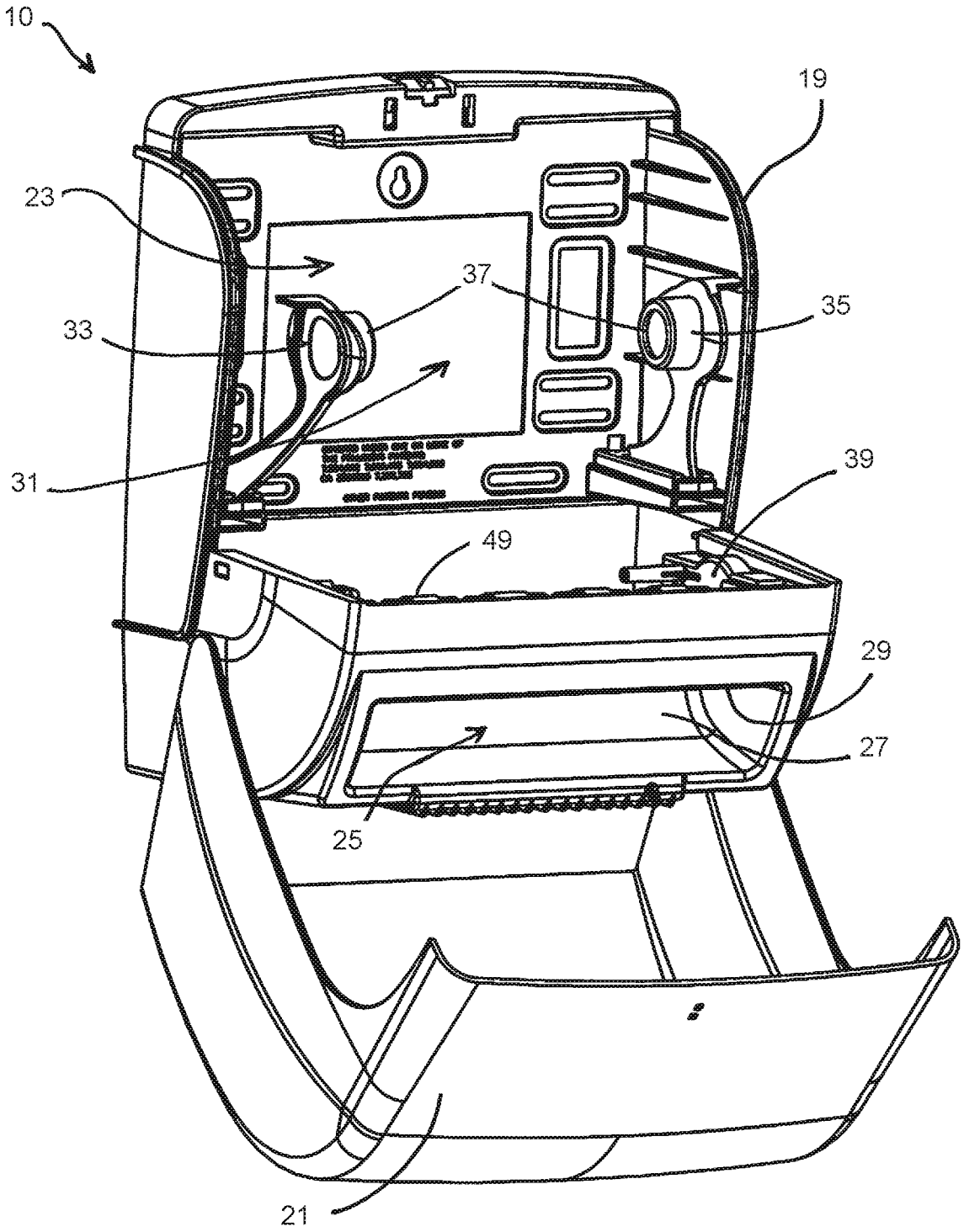
FIG. 2 is a further perspective view of the dispenser of FIG. 1, but with the cover open.
Figure 3:
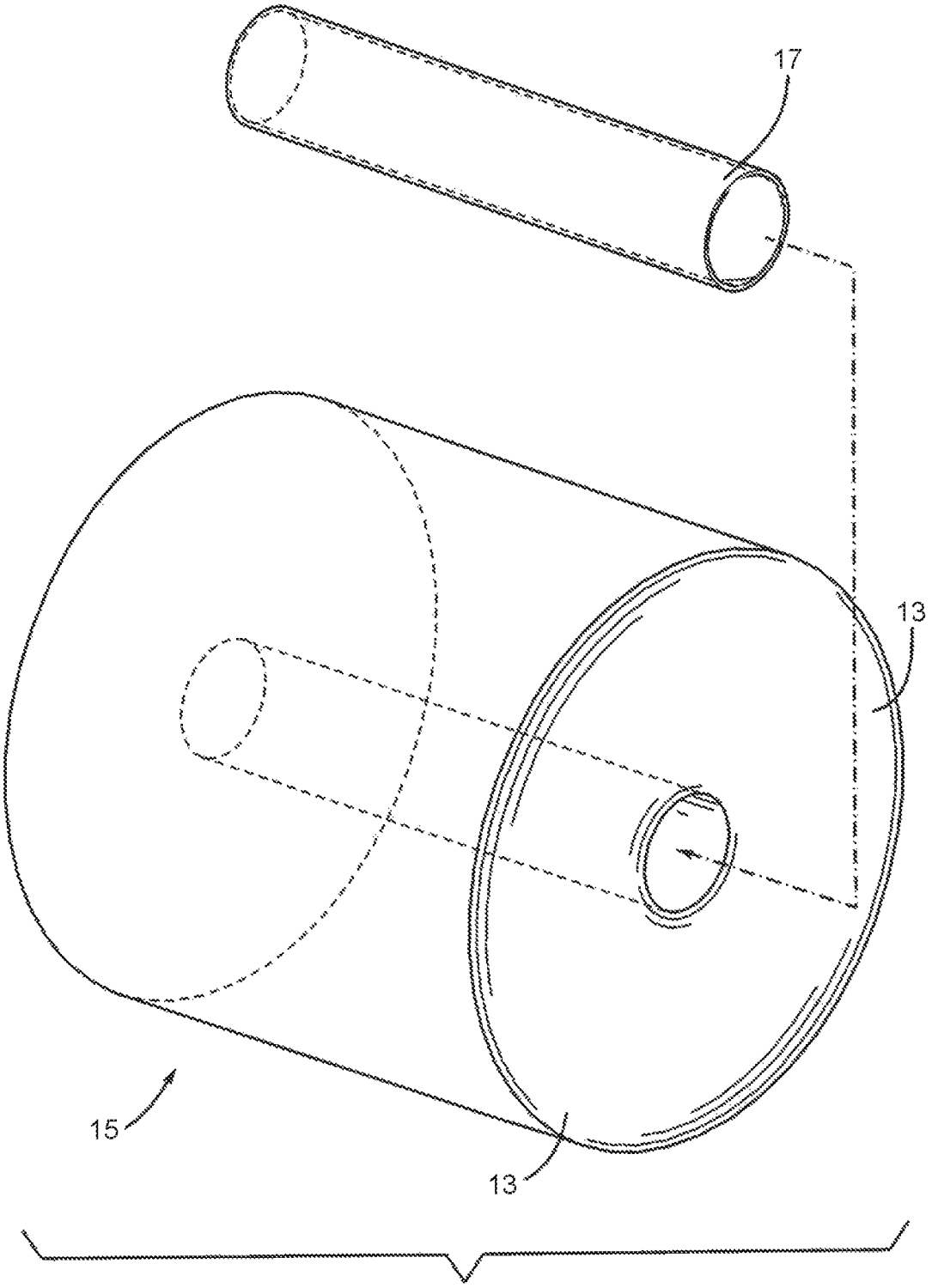
FIG. 3 is a roll of sheet material of the type which may be dispensed by the dispenser of FIGS. 1-2.
Figure 4:
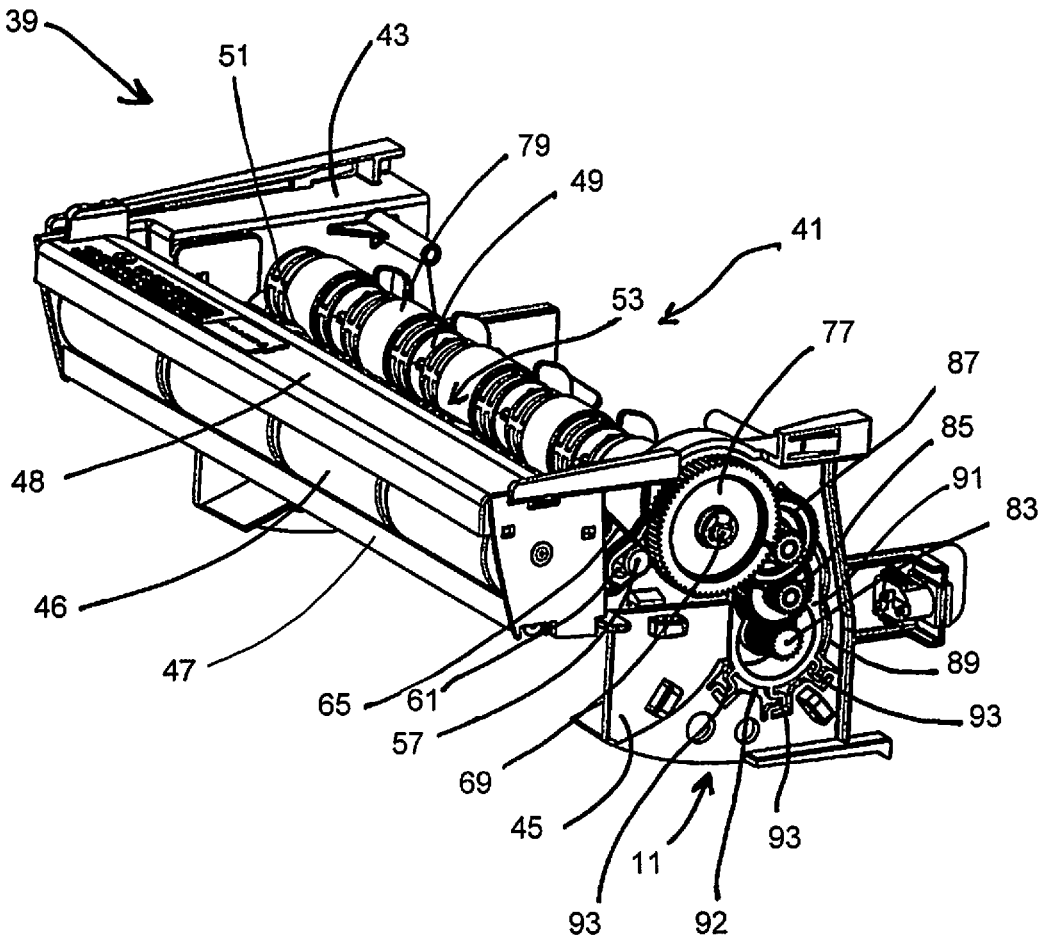
FIG. 4 is a perspective view of an exemplary chassis for use with the dispenser of FIGS. 1-2 showing certain components of a first embodiment of a noise dampener.

Referring first to FIGS. 1-3, dispenser 10 may be of the type which is mounted on a vertical wall surface. When mounted on such a vertical wall surface, dispenser 10 is easily accessible so that a user can receive sheet material 13, such as paper towel, from dispenser 10. Preferably, dispenser 10 is adapted to dispense sheet material 13 from a roll 15 of sheet material 13. As is well known, sheet material 13 in roll 15 form may comprise a hollow cylindrically-shaped tubular core 17 with a continuous web of sheet material 13 wound around core 17. Core 17 may be a hollow cylindrical tube made of cardboard, plastic or the like. The sheet material roll 15 of FIG. 3 is of paper towel, but roll 15 could be any suitable sheet material such as craft paper, tissue paper, and cloth towel.

Referring further to FIGS. 1-3, dispenser 10 may include a housing 19 and a front cover 21. Cover 21 may pivot between closed and open positions. Cover 21 may be locked in the closed position to prevent unauthorized access to internal components of dispenser 10. The open position of cover 21 permits an attendant to service dispenser 10 and to replace a depleted roll of sheet material 15, or a core 17, with a full sheet material roll 15. The interior 23 of housing 10 provides a sort of chamber which can amplify noise produced by dispenser 10 during operation. Housing 19 may include a discharge opening 25 through which sheet material 13 is output to a user. Curved housing bottom wall 27 serves to guide a sheet material 13 tail (not shown) out of discharge opening 25 for gripping by a user. A tear bar 29 may be provided along an upper portion of discharge opening 25 to allow a user to lift up and tear off a single sheet from the web of sheet material 13. Housing 19 and cover 21 may be made of any suitable material or materials such as formed sheet metal, plastic, combinations of metal and plastic, and like materials.

Referring next to FIGS. 2-3, a sheet material roll holder 31 may be provided to support a sheet material roll 15 within housing 19 and behind cover 21. Roll holder 31 may include right and left roll supports 33, 35 each including a mandrel 37 which is inserted into an opposite end of core 17. Roll supports 33, 55 may each be of a resilient material and may be spread apart so that each mandrel 37 can be inserted into an opposite end of core 17. Roll 15 is free to rotate when mounted on roll supports 33, 35 and roll 15 rotates as the web of sheet material 13 is pulled from roll 15 and out of dispenser 10 as described below. As will be appreciated, any type of roll holder structure can be utilized to support a roll 15 of sheet material 13. For example, roll holder 31 could be a rod (not shown) inserted through core 17 of the roll 15. Such a rod may be supported at its ends by housing 19.

Referring to FIGS. 2 and 4-10, a chassis 39 may be provided to support certain components of a dispensing mechanism 41. Chassis 39 of the examples may comprise a first sidewall 43, a second sidewall 45, 45*a*, and a middle portion 47 spanning between first and second sidewalls 43, 45, 45*a*. Middle portion 47 may include a location for four batteries (one battery indicated by reference number 46) and a battery cover 48. First and second sidewalls 43, 45, 45*a* may be joined or connected at a respective opposite end of middle portion 47 by any suitable means, such as by snap-together fitments, or by mechanical fasteners, or by adhesive, or by combinations of the foregoing. The joined-together chassis 39 may be a rigid self-supporting unit. In other embodiments, chassis 39 may be an integral part of housing 19. In the examples, sidewall 45, 45*a* may be modified to include a different dampener embodiment 11, 11*a* with all other components of chassis 39 remaining the same in each embodiment.

In the examples, sidewalls 43, 45, 45*a* and middle portion 47 may all be made of plastic material and may be made, for example, by plastic injection molding processes. Representative plastic materials which may be implemented include nylon, acrylonitrile butadiene styrene (ABS), and high impact polystyrene (HIPS). The term "plastic" as used herein is intended to be expansive and means or refers to any of a group of synthetic or natural organic materials that may be shaped when soft and then hardened, including without limitation many types of resins, resinoids, polymers, cellulose derivatives and other materials.

Dispensing mechanism 41 can include a drive roller 49 and a tension roller 51 both supported by chassis 39. Tension roller 51 may be urged into abutment against drive roller 49 to provide a nip 53 at the junction of the drive and tension rollers 49, 51. Sheet material 13 in nip 53 is pressed firmly against drive roller 49 by tension roller 51. Motor-powered rotation of drive roller 49 advances sheet material 13 through nip 53. Tensioning of sheet material 13 between nip 53 and sheet material roll 15 rotates sheet material roll 15 on roll holder 31 as sheet material 13 is pulled from roll 15. Advancing of sheet material 13 past nip 53 outputs sheet material 13 from dispenser 10 through discharge opening 25.

Tension roller 51 may include axially-aligned stub shafts 55, 57 at opposite ends of tension roller 51 enabling tension roller 51 to rotate on a rotational axis. Axially-aligned stub shafts 55, 57 may be inserted through elongate slots 59, 61 in a respective first or second chassis sidewall 43, 45, 45*a*. Elongate slots 59, 61 are angled toward a rotational axis 70 of drive roller 49 enabling tension roller 51 to translate toward and, alternatively, away from drive roller 49, while supported by chassis 39 sidewalls 43, 45, 45*a*. Stub shafts 55, 57 are biased toward drive roller 49 by torsion springs 63, 65 providing a force which urges tension roller 51 toward and into abutment with drive roller 49 to form nip 53. Tension roller 51 may be made of any suitable material, such as wood, plastic, metal and combinations of materials.

In the embodiment, drive roller 49 may include a stub shaft 67 and a drive shaft 69. The stub and drive shafts 67, 69 may be axially-aligned and at opposite ends of drive roller 49. Axially-aligned stub and drive shafts 67, 69 may each be journaled in a respective first or second chassis sidewall 43, 45, 45*a* enabling drive roller 49 to rotate on a single rotational axis 70 which may be parallel to the rotational axis of tension roller 51. Stub and drive shafts 67, 69 may be journaled in a low-friction acetyl bushing 71, 73 seated in a respective sidewall 43, 45, 45*a*. Sidewalls 43, 45, 45*a* are transverse to the rotational axis 70 of drive roller 49 in the example. Drive shaft 69 may extend through and past sidewall 45, 45*a* and include a flattened surface 75 extending past sidewall 45, 45*a* to receive a drive gear 77 for purposes of powering drive roller 49 rotation as described in more detail herein.

Drive roller 49 may be constructed in any suitable manner enabling sheet material 13 to be advanced through nip 53. Drive roller 49 may be made of plastic, wood or any other suitable material or combinations of materials. Drive roller 49 may be provided with tactile or frictional surfaces 79 around circumference of drive roller 49 to improve gripping of the sheet material 13 in nip 53 and more positive advancement of sheet material 13 through nip 53.

FIGS. 4-10 illustrate two noise dampener embodiments 11, 11*a*, each of which may be implemented with dispenser 10 and other types of sheet material dispensers. Each dampener embodiment 11, 11*a* may be used with the same dispensing mechanism 41 including motor 81, pinion gear 83, idler gears 85, 87 and drive gear 77 as described herein. For convenience and brevity, like reference numbers are used to describe like parts among the different dampener embodiments 11, 11*a*.

In each dampener embodiment 11, 11*a*, a modified chassis 39 sidewall 45, 45*a* may be provided to isolate motor 81 and gears 83, 85, 87 from chassis 39 to thereby lessen or eliminate audible noise to a user as described herein. Chassis 39 sidewall 45, 45*a* each incorporates novel design improvements which simplify chassis 39 and sidewall 45, 45*a* structure and design, providing an opportunity for improved dispenser 10 operation with reduced cost. Cost reduction in sheet material dispensers 10 is important because the dispenser market is competitive.

Referring then to the examples of FIGS. 4-10, sidewall 45, 45*a* of chassis 39 provides a motor 81 support structure and sidewall 45, 45*a* includes structure of dampener 11, 11*a* integrated therein, providing an integral dampener 11, 11*a*. In the examples, the dampener structure 11, 11*a* integrated into sidewall 45, 45*a* includes a motor support component 89, 89*a*, a motor mount component 91, 91*a*, a gap 92, 92*a* and at least one connector component 93, 93*a*. In the examples, motor support component 89, 89*a*, motor mount component 91, 91*a*, gap 92, 92*a* and connector component 93, 93*a* may each comprise portions of sidewall 45, 45*a*. In such embodiments, dampener 11, 11*a* structure enables sidewall 45, 45*a* to be manufactured as a single or unitary (i.e., integrated) part, thereby improving and simplifying design and providing an opportunity for cost reduction by making the part in a single production process step.

Motor support structure other than sidewall 45, 45*a* can be utilized to implement dampener 11, 11*a* structure according to the invention. For example, a support structure attached to sidewall 45, 45*a*, or otherwise associated with dispenser housing 19 could be utilized.

In the examples, motor support component 89, 89*a* is a region of sidewall 45, 45*a* near, and preferably around (i.e., surrounding) motor mount component 91, 91*a*. Motor support component 89, 89*a* may support motor 81 mounted on motor mount component 91, 91*a* with respect to sidewall 45, 45*a*, chassis 39 and dispenser 10. In the examples, sidewall 45, 45*a* may lie in a plane 95 and sidewall 43 may lie in a different plane (not shown) parallel to plane 95. Such planes (e.g., plane 95) may be transverse to drive and tension rollers 49, 51 and middle portion 47 of chassis 39. Motor support component 89, 89*a* may also lie in and define plane 95. Importantly, the entirety of motor support component 89,

89*a* and sidewall 45, 45*a* need not lie in plane 95 as parts projecting outside of plane 95 may be included consistent with the invention.

Also in the examples, sidewall 45, 45*a* may further include a motor mount component 91, 91*a* adjacent the motor support component 89, 89*a*. Motor mount component 91, 91*a* may support motor 81 with respect to sidewall 45, 45*a*, chassis 39, and dispenser 10. In the examples, motor mount component 91, 91*a* may be within (i.e., surrounded by) motor support component 89, 89*a* within a plane indicated by reference number 95 in FIG. 6 and as illustrated by the perspective and side views illustrated in FIGS. 4-10. Stated another way, motor mount component 91, 91*a* may lie at least partially in plane 95. It is contemplated that parts of motor mount component 91, 91*a* may project outside of plane 95. In other embodiments motor mount component 91, 91*a* may lie fully outside of plane 95.

Motor mount component 91, 91*a* may include a mount location 97 for motor 81 and may also include shafts 99, 101 for rotational support of idler gears 85, 87 which mesh with pinion 83 and drive gears 77 to rotate drive roller 49. In the examples, motor mount 97 location is on an inner side 103 of motor mount component 91, 91*a*. Shafts 99, 101 for idler gears 85, 87 may be on and project out from outer side 105 of motor mount component 91, 91*a*. Inner and outer sides 103, 105 are terms relative to chassis 39 in the examples with inner side 103 facing toward an interior of chassis 39 and outer side 105 facing away from chassis 39. In the examples, motor mount location 97 and shafts 99, 101 are shown as being transverse to plane 95 to support pinion 83 and idler 85, 87 gears parallel to plane 95. Shafts 99, 101 and gears 83-87 may lie outside of plane 95 depending on the depth of plane 95.

A problem with conventional dispensers is that motor 81 (e.g., motor armature 137 and any gears which may be internal to motor 81) together with gears external to motor, such as gears 83, 85, 87, and 77, are all moving parts which produce noise audible to a user during operation. Such parts (i.e., motor 81 and gears 77, 83-87) also produce vibration. The vibration can cause chassis 39 and other dispenser 10 parts to vibrate, producing resonant noise which can be amplified within housing 19. An advantage of a motor mount component 91, 91*a* which carries motor 81, pinion gear 83 and idler gears 85, 87 is that these moving parts are isolated from sidewall 45, 45*a* and chassis 39. Isolation of motor 81, pinion gear 83 and idler gears 85, 87 provides an opportunity to limit transfer of noise and vibration into chassis 39 and dispenser 10 where that noise and vibration would be amplified, thereby attenuating noise and vibration and making operation of dispenser 10 noticeably quieter to a user.

Referring again to FIGS. 4-10, dampener 11, 11*a* may include a gap 92, 92*a* spanned by at least one, and preferably a plurality of dampening connectors 93, 93*a*. In the examples, gap 92, 92*a* may be defined by and between an outer edge 111 of motor support component 89, 89*a* and an outer edge 113 of motor mount component 91, 91*a* spaced from edge 111. Gap 92, 92*a* spaces motor mount component 91, 91*a* from motor support component 89, 89*a*. In embodiments, gap 92, 92*a* may have a minimum width between outer edge 111 of motor support component 89, 89*a* and outer edge 113 of motor mount component 91, 91*a* of at least about 0.100 inches with greater spacing and combinations of different spacing being contemplated in accordance with the invention.

Gap 92, 92*a* may lie in plane 95. In embodiments, motor support component 89, 89*a*, motor mount component 91, 91*a*, and gap 92, 92*a* may all lie at least partially in plane 95.

Gap 92, 92*a* of the examples is shown as having a generally elongate or "race track" type appearance when viewed from the side as illustrated in FIGS. 6-10. However, gap 92, 92*a* need not have any particular geometry provided that the desired spacing of motor mount component 91, 91*a* from motor support component 89, 89*a* is provided.

In the examples, gap 92, 92*a* provides at least partial separation of motor mount component 91, 91*a* and moving parts carried thereon (e.g., motor 81, gears 83-87) from chassis 39. In the examples, gap 92, 92*a* may be considered to be substantially around motor mount component 91, 91 in that gap 92, 92*a* is around edge 113 of motor mount component 91, 91 with the exception of connectors 93, 93*a*. Gap 92, 92*a* is thought to be most effective at attenuating noise and vibration the more such gap 92, 92*a* surrounds motor mount component 91, 91*a* and the less connectors 93, 93*a* connect or join motor support component 89, 89*a* to motor mount component 91, 91*a*. The manufacturer can select a gap 92, 92*a* which surrounds motor mount component 91, 91*a* to a lesser or greater extent based on the desired level of noise attenuation.

In the examples of the noise-dampening structure exemplified by dampeners 11, 11*a*, gap 92, 92*a* is void of sidewall 45, 45*a* material and filled with ambient air. Noise and vibration cannot cross gap 92, 92*a* and into sidewall 45, 45*a* because of the discontinuity of sidewall 45, 45*a* caused by gap 92, 92*a*. Noise and vibration movement stopped by gap 92, 92*a* is unable to produce resonant noise elsewhere in dispenser 10. Accordingly, gap 92, 92*a* serves to isolate motor mount component 91, 91*a*, motor 81 and gears 83, 85, 87 from sidewall 45, 45*a* and chassis 39, attenuating noise and vibration audible to a user of the dispenser 10.

In the examples of FIGS. 4-10, noise dampening connectors 93, 93*a* provide a bridge across (i.e., extend across, or span) a respective gap 92, 92*a* and join motor support component 89, 89*a* to motor mount component 91, 91*a*, thereby providing at least partial support for motor mount component 91, 91*a* with respect to the motor support component 89, 89*a*. In dampener embodiments 11 and 11*a*, dampening connectors 93, 93*a* provide all of the support for motor mount component 91, 91*a* with respect to the motor support component 89, 89*a*. Dampener embodiment 11 is provided with five connectors 93 while dampener embodiment 11*a* is provided with three connectors 93*a*, each consisting of two legs 129, 131.

Connectors 93, 93*a* represent supports which may be narrow, or thinner, relative to sidewall 45, 45*a*, and motor support component 89, 89*a*, and motor mount component 91, 91*a*. Examples of this relationship are illustrated in FIGS. 4-10. In embodiments, dampening connectors 93, 93*a* should be sufficiently robust and/or numerous to support motor mount component 91, 91*a* with respect to motor support component 89, 89*a*, yet may be sufficiently narrow to maximize the gapped spacing between motor support component 89, 89*a* and motor mount component 91, 91*a* and around motor mount component 91, 91*a*, limiting passage of motor 81 and gear 83, 85, 87 noise and vibration into sidewall 45, 45*a*, chassis 39 and generally into dispenser 10. It is desirable that gap 92, 92*a* extend substantially around motor mount component 91, 91*a* to limit noise and vibration transfer into chassis 39. In embodiments, it can be desirable for dampening connectors 93, 93*a* to be sufficiently flexible to enable low-oscillating movement of connectors 93, 93*a* so that connectors 93, 93*a* can themselves vibrate to dissipate or attenuate motor 81 and gear 83, 85, 87 noise and vibration further contributing to attenuation of noise audible to a user of dispenser 10. Flexing can be made possible by providing connectors 93, 93*a* which are narrow or thin relative to sidewall 45, 45*a* and therefore are capable of oscillating movement or flexing.

Dampening connectors 93, 93*a* may each have a first connector end 115 integral with motor support component 89, 89*a*, a second connector end 117 integral with motor mount component 91, 91*a* and a connector body 119 integral with the first and second connector ends 115, 117.

Sidewall 45, 45*a*, motor support component 89, 89*a*, motor mount component 91, 91*a*, and dampening connectors 93, 93*a* may all be a single, or one-piece, unit. Thus the integral connector ends 115, 117 and connector body 119 may all be elements of the sidewall 45, 45*a* or other support structure itself. Sidewall 45, 45*a*, motor support component 89, 89*a*, motor mount component 91, 91*a*, and dampening connectors 93, 93*a* may be made of the same plastic material and may be made together as a one-piece unit, for example, by plastic injection molding processes. In such embodiments, gap 92, 92*a* may be formed in sidewall 45, 45*a* to provide a sidewall 45, 45*a* with integral noise-dampening structure of the type illustrated by dampeners 11, and 11*a*. Therefore, motor support 89, 89*a*, motor mount 91, 91*a* and connectors 93, 93*a* may all be of the same representative plastic materials as sidewall 45, 45*a*. Examples of representative plastic materials which may be implemented include nylon, ABS, and HIPS as previously described.

Manufacture of sidewall 45, 45*a* including dampener 11, 11*a* as a single part, or one-piece unit, represents an opportunity for significant simplification and cost reduction. Costs can be reduced because sidewall 45, 45*a* can be made in a single step, for example, by injection molding, and the number of parts can be reduced.

Dampener structure 11, 11*a* may be manufactured according to techniques other than solely by plastic injection molding while still providing a one-piece unit. For example, sidewall 45, 45*a* may be manufactured as a single part one-piece unit, for example by plastic injection molding. Subsequent to manufacture by plastic injection molding, machining processes could be implemented to remove the sidewall 45, 45*a* plastic material to form a respective gap 92, 92*a* and to thereby produce motor support component 89, 89*a*, motor mount component 91, 91*a*, and dampening connectors 93, 93*a* supporting motor mount component 91, 91*a* with respect to the motor support component 89, 89*a*.

Each of dampener embodiments 11, 11*a* will now be described in connection with their respective figures.

Referring to FIGS. 4-8, those figures illustrate one embodiment of noise-dampening structure in the form of dampener 11 which includes motor support component 89, motor mount component 91, gap 92, and noise dampening connectors 93. Each connector is indicated by reference number 93 for brevity. In the example, the five connectors 93 provide five connection points of motor support component 89 and motor mount component 91 with chassis 39 and sidewall 45. While five connection points are indicated, no particular number of connection points are required.

Turning then to FIGS. 4-8 and the example illustrated therein, motor support component 89 comprises an outer edge 111 formed by three-sided squared regions of sidewall 45, one each for each connector 93. Motor mount component 91 comprises a generally oval-shaped platform when viewed from a side as in FIGS. 4-8. Motor mount location 97 may be on inner side 103 of motor mount 91 component and idler gear shafts 99, 101 project away from outer side 105 of motor mount component 91.

Motor support component 89 may be separated from motor mount component 91 by gap 92 defined between edges 111, 113.

Bridging gap 92 and connecting motor support component 89 and motor mount component 91 are five dampening connectors 93. In the example, connector end 115 is integral with one of the squared regions of outer edge 111 of motor support component 89 and connector end 117 is integral with outer edge 113 of motor mount component 91. In the example, motor support component 89, motor mount component 91, gap 92, and dampening connectors 93 all lie in plane 95, as does sidewall 45.

In the example of FIGS. 4-8, each dampening connector 93 is provided with a connector body 119. Connector body 119 may have a substantially U-shaped portion 121 as shown including first and second legs 123, 125 defining a slot, or gap, 127 between legs 123, 125. Legs 123, 125 may turn outwardly approximately 90 degrees to terminate in a respective connector end 115, 117 joined respectively to motor support component 89 and motor mount component 91. In the example, U-shaped portion 121 of connectors 93 is entirely within plane 95.

The U-shape portion 121 is advantageous because it permits implementation of a relatively longer connector 93 across gap 92 as compared with an axial connector across the same gap 92. The longer connector 93 made possible by U-shaped portion 121 provides for a greater length along which noise and vibration may be dissipated, helping to attenuate noise discernible to a user of dispenser 10. Without wishing to be bound by any particular theory, it is thought that any rotational forces applied by the motor armature 137 are in the same plane as connectors 93 and U-shaped portion 121 in particular. When force is generated by armature 137 during armature 137 rotation, U-shaped portion 121 and legs 123, 125 are able to mechanically deform, or flex, or oscillate in plane 95, attenuating vibration transmitted from motor 81 and motor support component 89 and limiting transfer of that noise and vibration into chassis 39 and dispenser where resonant noise would be amplified and made audible to a user. It should be noted that connector 93 could be of shapes and configurations other than the U-shape illustrated in FIGS. 4-8, and could, for example, be of an axial construction. It is thought that the longer each connector 93, the better the noise attenuation provided by each connector 93.

As previously described, dampener structure 11 of the embodiment of FIGS. 4-8 may be manufactured as a unitary one-piece unit, for example, by plastic injection molding of the entire sidewall 45 in a single molding process, by machining, or by any other suitable technique.

Figure 9:
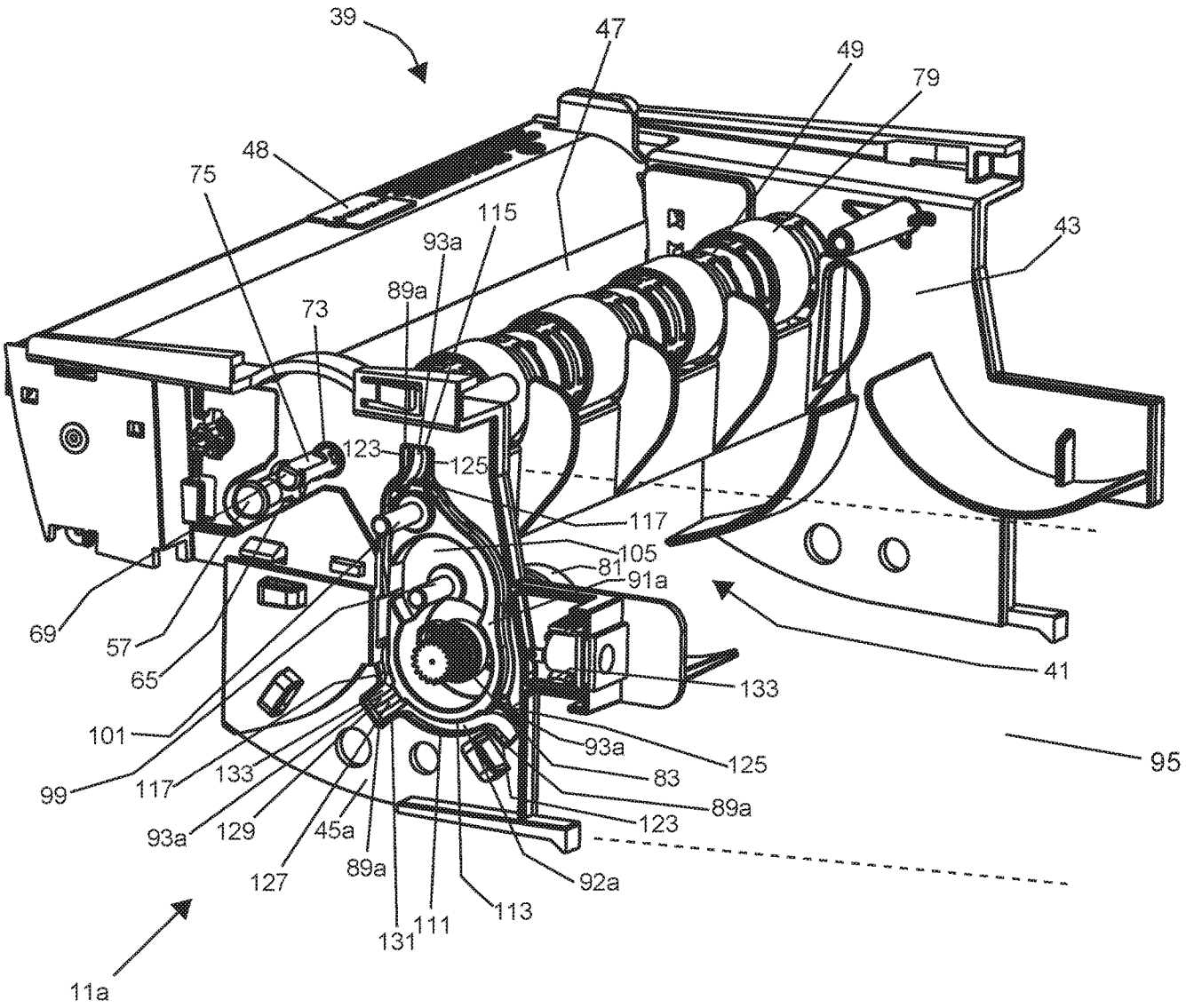
FIG. 9 is a perspective view of portions of an exemplary chassis and sidewall for use with the dispenser of FIGS. 1-2, but showing certain components of a second embodiment of a noise dampener in accordance with the invention.
Figure 10:
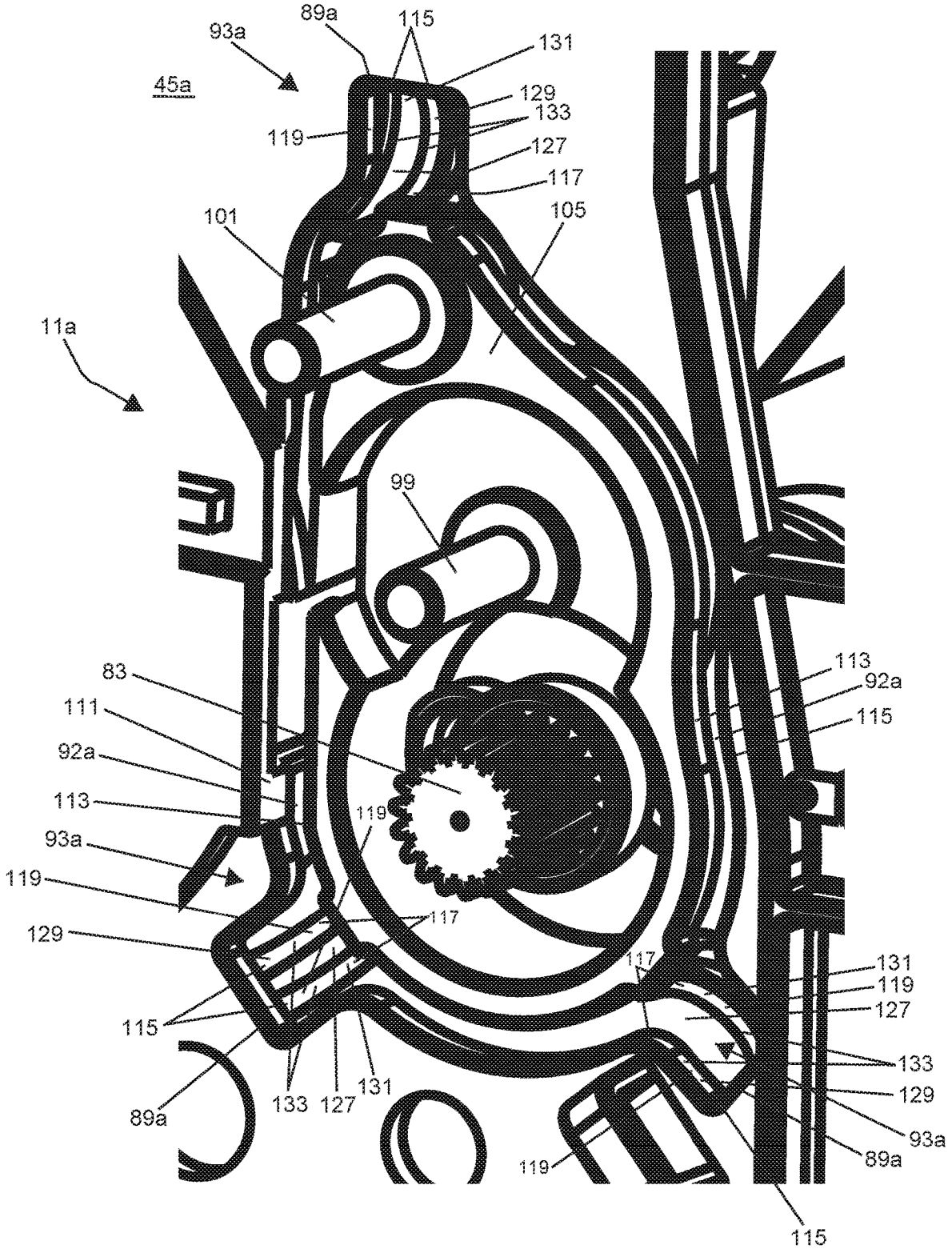
FIG. 10 is an enlarged view of the noise dampener of FIG. 9.

FIG. 9 and the enlarged portion of FIG. 9 shown in FIG. 10, illustrate another embodiment of noise-dampening structure in the form of dampener 11*a* including motor support component 89*a*, motor mount component 91*a*, gap 92*a*, and dampening connectors 93*a*, three of which are provided in the example. Each connector is indicated by reference number 93*a* for brevity. Dampener 11*a* may be a component of a sidewall 45*a* which is otherwise identical to sidewall 45 as comparison of FIG. 9 with FIG. 6 indicates. In the example of FIGS. 9-10, connectors 93*a* provide three connection points between motor support component 89*a* and motor mount component 91*a* spanning gap 92*a*. FIGS. 9-10 illustrate that no particular number of connection points are required, provided the requisite support of motor mount component 91*a* with respect to motor support component 89*a* exists.

Referring again to FIGS. 9-10, each motor support component 89*a* is a region of sidewall 45*a* and, in the example, comprises a three-sided squared region of outer edge 111 of sidewall 45*a*. In the example, connector end 115 is integral with one of the squared regions of outer edge 111 of motor support component 89*a*, and connector end 117 is integral with outer edge 113 of motor mount component 91*a*.

Motor mount component 91*a* may be a platform as described in connection with motor mount component 91, including a generally oval-shaped platform defined by an edge 113, a motor mount location 97 on inner side 103 and idler gear shafts 99, 101 projecting away from outer side 105 of motor mount component 91*a*.

Motor support component 89*a* may be separated from motor mount component 91*a* by gap 92*a* defined between edges 111, 113 of motor support and motor mount components 89*a*, 91*a*. Motor support and motor mount components 89*a*, 91*a* and gap 92*a* may all lie in plane 95 together with sidewall 45*a*.

FIGS. 9-10 illustrate that a dampener embodiment 11*a* may be implemented with dampening connectors 93*a* that differ in structure from dampening connectors 93 of FIGS. 4-8 consistent with the invention. According to FIGS. 9-10, each of the three dampening connectors 93*a* illustrated may include a pair of parallel spaced-apart legs 129, 131. In the example, each of legs 129, 131 includes a body 119 with a bowed portion 133 bowed inwardly away from inner side 103 of motor mount portion 91*a* and toward chassis 39 sidewall 43. The inwardly-bowed portion 133 of such legs 129, 131 may be bowed in a direction parallel to an axis 135 of motor 81 armature 137 and pinion gear 83 rotation. Connector 93*a* legs 129, 131 may be integral (at ends connector ends 115) with one of the squared parts of outer edge 111 of motor support component 89*a* and may be integral (at connector ends 117) with outer edge 113 of motor mount component 91*a*.

Without wishing to be bound by any particular theory, it is thought that orientation of bowed portion 133 parallel to axis 135 is advantageous because such orientation can improve dissipation of motor 81 and gear 83, 85, 87 noise and vibration. Attenuation of such motor 81 and gear 83, 85, 87 noise and vibration can be further attenuated by projection of bowed portion 133 past inner side 103 of motor support component 89*a* and outside of plane 95. The longer connector 93*a* made possible by a bowed portion 133 provides for a greater length along which noise and vibration may be dissipated helping to attenuate noise discernible to a user of dispenser 10. And, the relative narrowness of legs 129, 131 would permit connectors 93*a* to vibrate in a low-oscillating manner to dissipate vibration from motor 81 and gears 83, 85, 87. Thus, connectors 93*a* may be sufficiently rigid to support motor mount component 91*a* with respect to motor support component 89*a* yet may also be sufficiently flexible to attenuate vibration and to prevent transfer of noise and vibration into chassis 39 and dispenser 10, thus limiting any resonant noise from motor 81 operation.

As with the embodiment of FIGS. 4-8, dampener structure 11*a* of the embodiment of FIGS. 9-10 may be manufactured as a unitary one-piece unit, for example, by plastic injection molding of the entire sidewall 45 in a single molding process, by machining, or by any other suitable technique.

Each of the dampener embodiments 11 and 11*a* illustrated in FIGS. 4-10 may be used with the same dispensing mechanism 41, including chassis 39, drive and tension rollers 49, 51, motor 81, and gears 77, 83, 85, 87. Each dampener embodiment 11-11*b* reduces or eliminates noise and vibration produced by motor 81 and gears 77, 83, 85, 87 during dispenser 10 operation, providing a dispenser 10 which is more audibly quiet to a user.

Referring then to FIGS. 4-10, a DC motor 81 may be secured to a motor mount location 97 on inside surface 103 of motor mount component 91, 91*a*. Motor 81 may be mounted to motor mount component 91, 91*a* mount location 97 by fasteners, such as machine screws 157, 159. A suitable DC motor 81 is the model P/N 6235408 motor available from Hankskraft, Inc. of Reedsburg, Wis. Motor 81 may be powered by a power supply apparatus such as four series-connected 1.5 volt D-Cell batteries (one battery indicated as 46 in FIG. 4) or a power supply apparatus consisting of direct current from a low-voltage transformer (also not shown). Motor 81 of dispensing mechanism 41 may be controlled by a control circuit (not shown) which may include a microcontroller and an on/off switch which may include a proximity sensor, pressure-actuated switch, or other switching device. The control circuit may set dispenser 10 in a dispenser "on" or a dispenser "off" state. Dispenser 10 is placed into the dispenser "on" state by a user-request for a sheet of sheet material 13.

Figure 5:
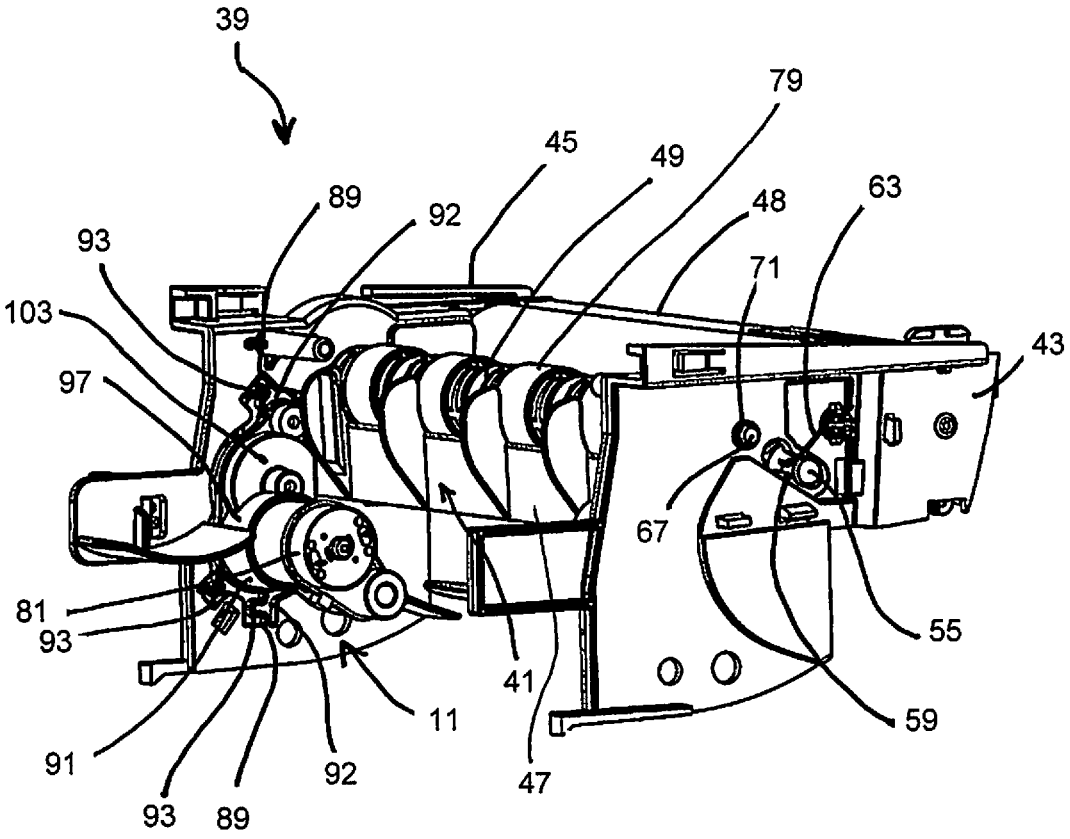
FIG. 5 is a further perspective view of the exemplary chassis of FIG. 4.
Figure 6:
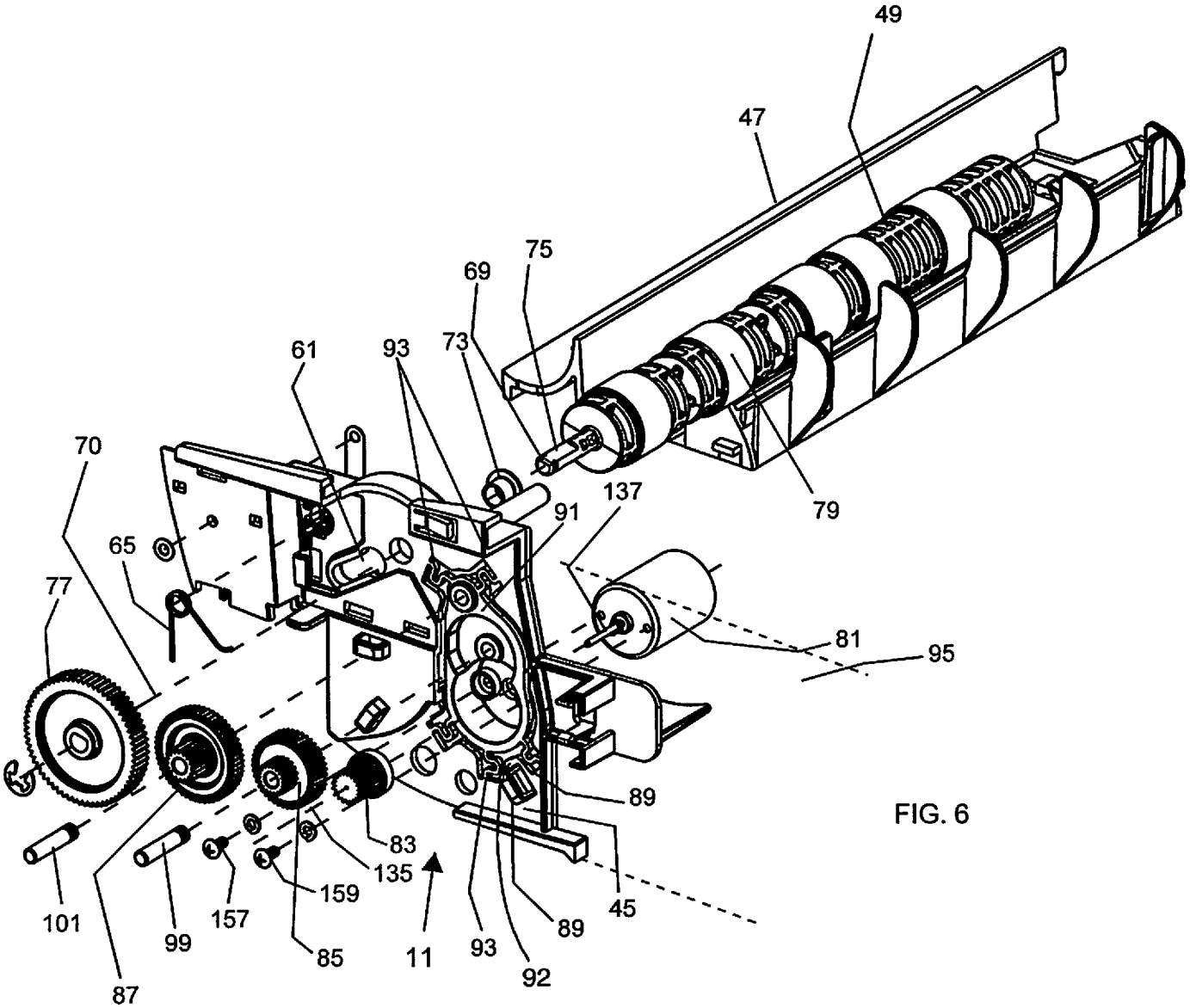
FIG. 6 is an exploded view of portions of the exemplary chassis of FIGS. 4-5 including an exemplary sidewall with a noise dampener.
Figure 7:
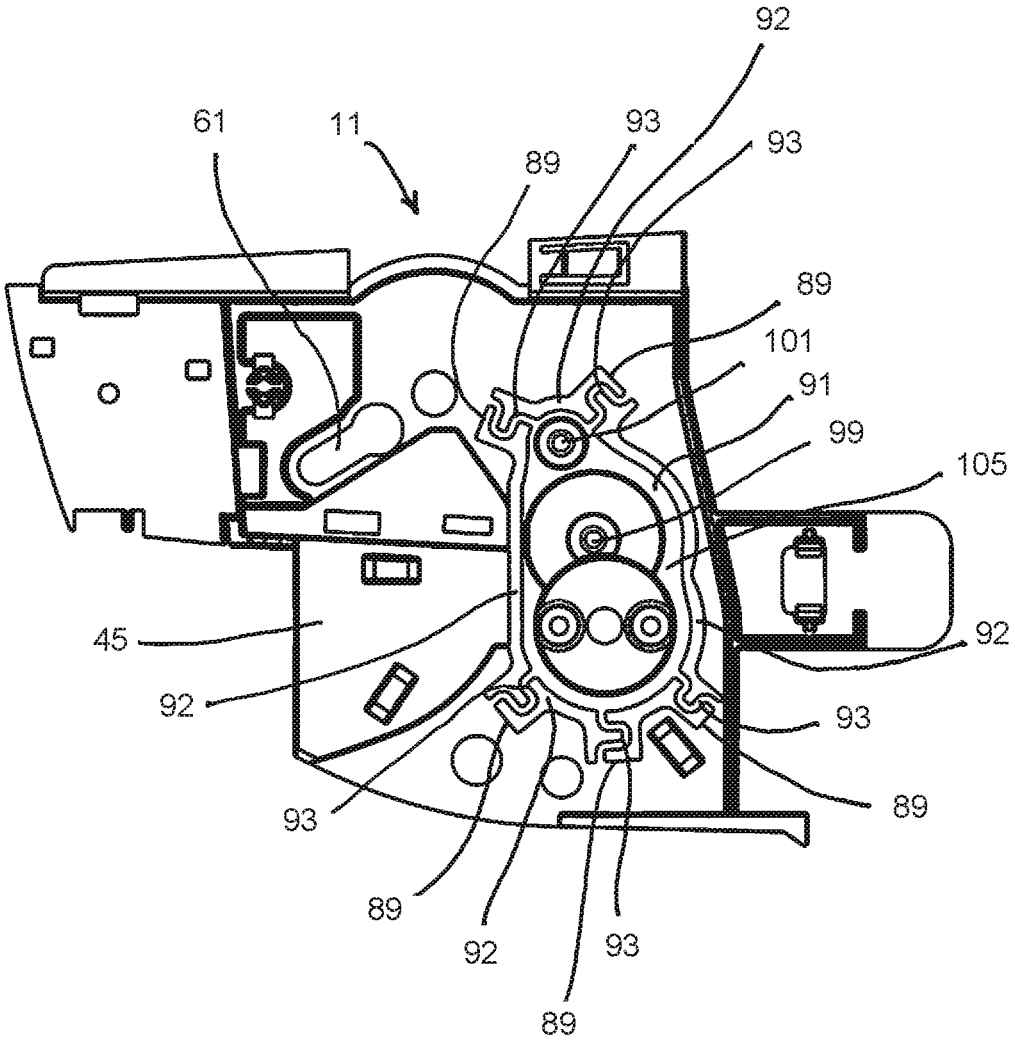
FIG. 7 is a side elevation view of the sidewall of FIGS. 4-6.
Figure 8:
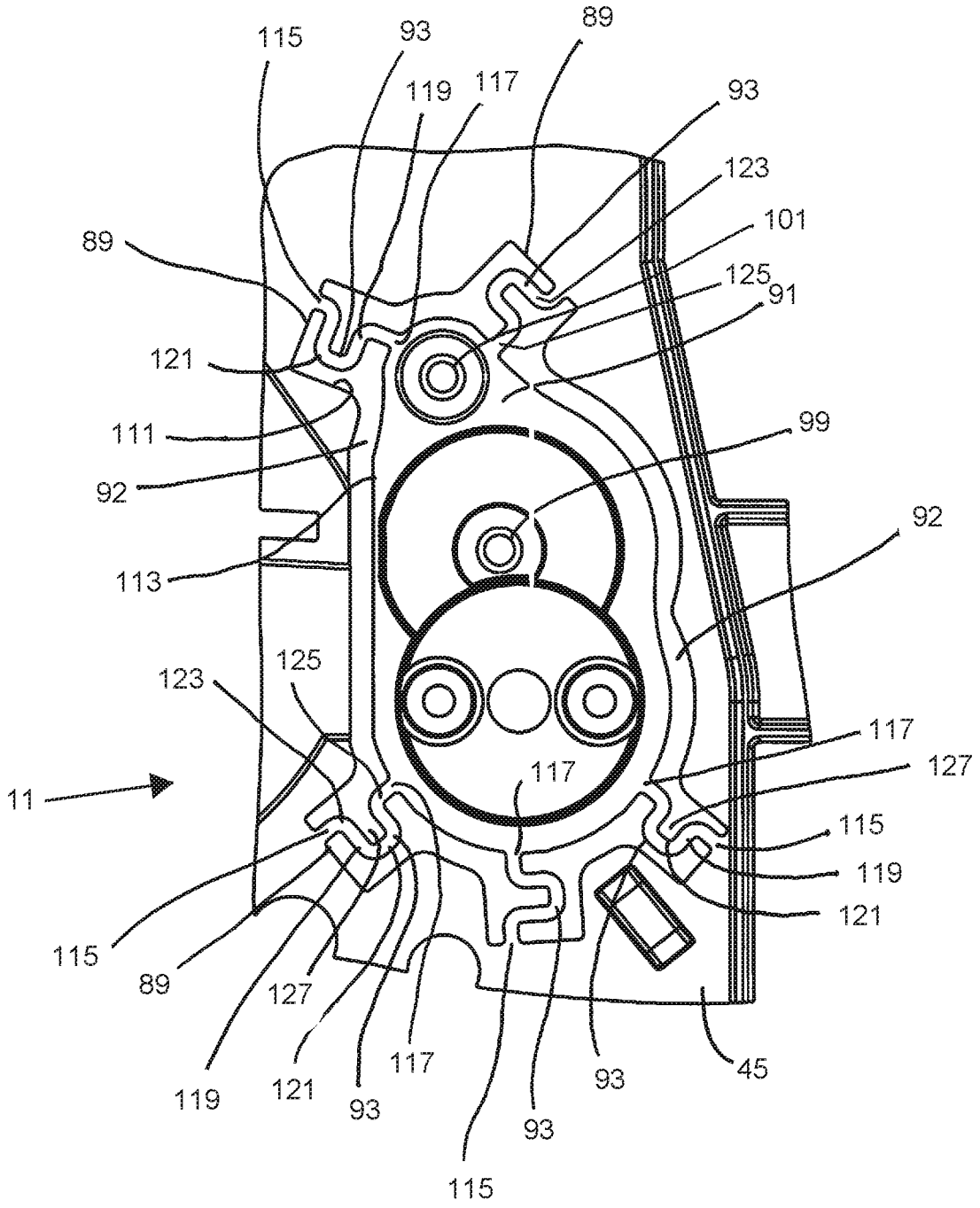
FIG. 8 is an enlarged side elevation view of the sidewall of FIG. 7.

Referring to FIGS. 5, 6 and 9, motor 81 drives a power-transmission assembly of dispensing mechanism 41 consisting of pinion gear 83, idler gears 85, 87 and drive gear 77. Gears 83-87 and 77 provide a reduction gear assembly in the example. Pinion gear 83 is mounted on motor armature 137. Armature 137 defines axis 135 of armature 137 rotation. Pinion gear 83 rotates idler gear 85 on shaft 99 which in turn rotates idler gear 87 on shaft 101. Idler gear 87 is in power-transmission relationship with drive gear 77 attached to drive roller 49 drive shaft 69. Motor-powered rotation of pinion 83 and idler gears 85, 87 powers rotation of drive gear 77 and drive roller 49.

Thus, motor 81 and gears 83, 85, 87 which produce much, if not all, of the dispenser 10 noise and vibration are all isolated from sidewall 45, 45*a* on motor support component 89, 89*a* in the examples.

In operation, dispenser 10, loaded with a roll 15 of sheet material 13, is placed in a dispenser "on" state by a user request for a sheet of paper towel or other material. In response to the user request, motor 81 is activated, causing armature 137 to rotate pinion gear 83, idler gears 85, 87 and drive gear 77. Rotation of drive gear 77 rotates drive roller 49 and tension roller 51 in abutment therewith to pull sheet material 13 through nip 53 and out of dispenser 10 through discharge opening 25 for presentment to the user.

High RPM rotation of motor 81 armature 137 rotation produces noise and vibration. Idler gears 85, 87 driven by pinion gear 83 on armature 137 rotate on idler shafts 99, 101 and movement of these gears 83, 85, 87 produces still more noise and vibration.

Each dampener 11, 11*a* embodiment attenuates such noise and vibration which would otherwise be audible to a user so that dispenser 10 operates quietly. In the examples, attenuation of the noise and vibration is made possible by the gapped spacing of the motor 81 and gears 83, 85, 87 from chassis 39. The spacing may be accomplished by means of a motor mount component 91, 91*a* which is integrated with and a part of dispenser support structure, such as motor support component 89, 89*a* of chassis 39 sidewall 45, 45*a*. Motor 81 noise and vibration of motor 81 and gears 83, 85, 87, 77 cannot cross gap 92, 92*a* and into sidewall 45, 45*a* and are lessened. Such motor noise and vibration are dissipated by ambient air in gap 92, 92*a*.

Connectors 93, 93*a* provide for support of motor mount component 91, 91*a* with respect to motor support component 89, 89*a*. Connectors 93, 93*a* may be sufficiently rigid to provide the needed support for motor support component 89, 89*a*, overcoming motor 81 and gear 83, 85, 87, 77 torque so that motor mount component 91, 91*a* remains supported in plane 95 in the examples of FIGS. 4-10 with gears 83, 85, 87 and 77 meshed in power-transmission relationship with drive roller 49. And yet connectors 93, 93*a* may also be sufficiently flexible to permit low levels of oscillation (i.e., vibration) to further dissipate vibration produced by motor 81 and gears 83, 85, 87 and delivered to connectors 93, 93*a*. Such connectors 93, 93*a* serve to dissipate noise. And, gap 92, 92*a* limits transfer of noise and vibration from motor 81 and gears 83, 85, 87 to sidewall 45, 45*a* and chassis 39, limiting resonant noise of dispenser 10. The result of noise damper 11, 11*a* is a dispenser 10 which operates quietly with little or no audible noise perceptible to a user of the dispenser 10.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. The disclosed noise-dampening structure embodied by the examples of dampeners 11, 11*a* may address some or all of the problems previously described. A particular embodiment need not address all of the problems described, and the claimed dampener 11, 11*a* should not be limited to embodiments comprising solutions to all of these problems. Further, several advantages have been described that flow from the structure and methods; the present invention is not limited to structure and methods that encompass any or all of these advantages. Those skilled in the relevant art, having the benefit of the teachings of this specification, may effect numerous modifications to the invention as described herein, and changes can be made without departing from the scope and spirit of the invention as defined by the appended claims. Furthermore, any features of one described embodiment can be applicable to the other embodiments described herein.

What is claimed is:

1. A motor support structure with an integral noise dampener for use with a sheet material dispenser, the motor support structure comprising:

a motor support component made of a plastic material;

a motor mount component adjacent the motor support component and made of the same plastic material as the motor support component, the motor support component and the motor mount component defining a noise-dampening gap therebetween; and a plurality of connectors made of the same plastic material as the motor support component and the motor mount component such that the connectors, motor support component, and motor mount component collectively comprise a unitary one-piece structure, the connectors bridging the gap and joining the motor support component and the motor mount component to provide support for the motor mount component with respect to the motor support component, the connectors further being sufficiently flexible to enable oscillating movement of the connectors to dissipate motor vibration and noise.

2. The motor support structure of claim 1 wherein the connectors each have a first end integral with the motor support component, a second end integral with the motor mount component and a connector body integral with the first and second ends.

3. The motor support structure of claim 2 wherein the motor support component, motor mount component and connectors are in a plane.

4. The motor support structure of claim 3 wherein the connectors further include a substantially U-shaped portion between the first and second ends and each U-shaped portion is entirely within the plane.

5. The motor support structure of claim 3 wherein the connectors further include a non-planar portion between the first and second ends and the non-planar portion is at least partially outside the plane.

6. The motor support structure of claim 2 wherein the gap defined by and between the motor support component and the motor mount component is at least about 0.100 inches between an edge of the motor support component and an edge of the motor mount component.

7. The motor support structure of claim 2 wherein the gap is substantially around the motor support component.

8. The motor support structure of claim 2 wherein the motor support component, motor mount component and connectors are all of a one-piece unit.

9. The motor support structure of claim 8 wherein the one-piece unit is molded of the plastic material.

10. The motor support structure of claim 8 wherein the gap is formed by removing the plastic material.

11. The motor support structure of claim 10 wherein the gap is machined from a sidewall of the motor support structure.

12. The motor support structure of claim 1 wherein the motor support component, motor mount component and connectors are elements of a dispenser chassis.

13. The motor support structure of claim 1 wherein the motor mount component has an inner surface and an outer surface and a motor is attached to the inner surface.

14. The motor support structure of claim 13 wherein:

the motor has an armature with a distal end through the motor mount component;

a first gear is on the armature distal end adjacent the outer surface; and at least a second gear is supported by the motor mount component adjacent the outer surface in power-transmission relationship with the first gear.

15. The motor support structure of claim 14 wherein the gears are in power-transmission relationship with a dispenser drive roller.

16. A sheet material dispenser including motor support structure with an integral noise dampener, the dispenser comprising:

a housing;

a sheet material holder;

drive and tension rollers forming a nip;

a chassis at least partially within the housing and supporting the drive and tension rollers;

a chassis sidewall made of a plastic material and including a motor support component;

a chassis sidewall motor mount component adjacent the motor support component and made of the plastic material, the motor support component and the motor mount component defining a noise-dampening gap therebetween;

a motor carried by the motor mount component in power-transmission relationship with the drive roller; and a plurality of connectors made of the same plastic material as the motor support component and the motor mount component, the connectors bridging the gap and joining the motor support and motor mount components into a unitary one-piece unit to support the motor mount component and motor with respect to the motor support component and chassis sidewall, the connectors being sufficiently flexible to enable oscillating movement of the connectors to dissipate motor vibration and noise.

17. The dispenser of claim 16 wherein the chassis sidewall, motor support component, motor mount component and connectors are all of a one-piece unit.

18. The dispenser of claim 17 wherein the connectors each have a first end integral with the motor support component, a second end integral with the motor mount component and a connector body integral with the first and second ends.

19. The dispenser of claim 18 wherein the gap is substantially around the motor support component.

20. The dispenser of claim 19 wherein the chassis sidewall, motor support component, motor mount component and connectors all define and lie in a plane.

21. The dispenser of claim 20 wherein the connectors further include a substantially U-shaped portion between the first and second ends and each U-shaped portion is entirely within the plane.

22. The dispenser of claim 20 wherein the connectors further include a non-planar portion between the first and second ends and the non-planar portion is at least partially outside the plane.

* * * * *